US011644795B2

(12) United States Patent
Takasawa

(10) Patent No.: US 11,644,795 B2
(45) **Date of Patent: *May 9, 2023**

(54) WATCH COMPONENT AND WATCH

(71) Applicant: Seiko Epson Corporation, Tokyo (JP)

(72) Inventor: Koki Takasawa, Suwa (JP)

(73) Assignee: SEIKO EPSON CORPORATION

( * ) Notice: Subject to any disclaimer, the term of this patent is extended or adjusted under 35 U.S.C. 154(b) by 0 days.

This patent is subject to a terminal disclaimer.

(21) Appl. No.: 17/012,125

(22) Filed: Sep. 4, 2020

(65) Prior Publication Data

US 2021/0072703 A1 Mar. 11, 2021

(30) Foreign Application Priority Data

Sep. 5, 2019 (JP) ..... JP2019-162005

(51) Int. Cl.

| | |
|---|---|
| ***G04B 37/22*** | (2006.01) |
| ***C22C 38/42*** | (2006.01) |
| ***C22C 38/48*** | (2006.01) |
| ***C22C 38/44*** | (2006.01) |
| ***C22C 38/04*** | (2006.01) |
| ***C22C 38/00*** | (2006.01) |
| ***C22C 38/02*** | (2006.01) |

(52) U.S. Cl.

CPC ..... *G04B 37/22* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C22C 38/48* (2013.01); *C21D 2211/001* (2013.01); *C21D 2211/005* (2013.01)

(58) Field of Classification Search

None

See application file for complete search history.

(56) References Cited

U.S. PATENT DOCUMENTS

| | | | | |
|---|---|---|---|---|
| 7,875,128 | B2 * | 1/2011 | Kuroda | C22C 38/22 148/232 |
| 8,303,168 | B2 | 11/2012 | Takasawa | |
| 2006/0130938 | A1 | 6/2006 | Kramer | |
| 2007/0217293 | A1 | 9/2007 | Takasawa | |
| 2017/0088912 | A1 | 3/2017 | Fukuda et al. | |

FOREIGN PATENT DOCUMENTS

| | | | |
|---|---|---|---|
| JP | 2000-155182 | A | 6/2000 |
| JP | 2005-097682 | A | 4/2005 |
| JP | 2007-056301 | A | 3/2007 |
| JP | 2007-239060 | A | 9/2007 |
| JP | 2009-069049 | A | 4/2009 |
| JP | 2013-101157 | A | 5/2013 |
| WO | 2021-100687 | A1 | 5/2021 |

* cited by examiner

*Primary Examiner* — Seth Dumbris
*Assistant Examiner* — Kim S. Horger
(74) *Attorney, Agent, or Firm* — Harness, Dickey & Pierce, P.L.C.

(57) ABSTRACT

A watch component includes an austenized ferritic stainless steel including a base including a ferrite phase, a surface layer formed on a surface of the base, the surface layer including an austenized phase, and a mixed layer formed between the base and the surface layer, the mixed layer being a layer in which the ferrite phase and the austenized phase are mixed. In a cross section taken along a depth direction from the surface, a thickness of the mixed layer is 45% or less of a thickness of the surface layer.

5 Claims, 3 Drawing Sheets

WATCH COMPONENT AND WATCH

The present application is based on, and claims priority from JP Application Serial Number 2019-162005, filed Sep. 5, 2019, the disclosure of which is hereby incorporated by reference herein in its entirety.

BACKGROUND

1. Technical Field

The present disclosure relates to a watch component and a watch.

2. Related Art

JP-A-2009-69049 discloses a housing, or more specifically, a shell and a case back, for a watch using ferritic stainless steel in which a surface layer is austenized by a nitrogen absorption treatment.

In JP-A-2009-69049, the surface layer of the ferritic stainless steel is austenized to obtain a hardness and corrosion resistance required for a housing for a watch.

In an austenization treatment using nitrogen gas, i.e., in a nitrogen absorption treatment, nitrogen enters the ferrite phase from the surface layer of the treatment target material, and the portion where the nitrogen concentration is greater than or equal to a prescribed nitrogen concentration changes to the austenized phase. Here, in the ferritic stainless steel of JP-A-2009-69049, the transfer rate of nitrogen into the ferrite phase is not uniform, and varies from place to place. Therefore, when forming an austenized phase of the thickness required for obtaining a hardness and corrosion resistance required for a housing for a watch, portions where the ferrite phase is significantly eroded by the austenized phase are formed in any portion of the surface layer. As a result, a portion where the ferrite phase that functions as the magnetic resistance functional layer is thin is formed, and consequently the magnetic resistance function as a watch component may be degraded.

SUMMARY

A watch component of the present disclosure includes an austenized ferritic stainless steel, the austenized ferritic stainless steel including a base including a ferrite phase, a surface layer formed on a surface of the base, the surface layer including an austenized phase, and a mixed layer formed between the base and the surface layer, the mixed layer being a layer in which the ferrite phase and the austenized phase are mixed. In a cross section taken along a depth direction from the surface, a thickness of the mixed layer is 45% or less of a thickness of the surface layer.

In the watch component of the present disclosure, the base may contain, by mass %, 18 to 22% Cr, 1.3 to 2.8% Mo, 0.05 to 0.50% Nb, 0.1 to 0.8% Cu, less than 0.5% Ni, less than 0.8% Mn, less than 0.5% Si, less than 0.10% P, less than 0.05% S, less than 0.05% N, and less than 0.05% C, with the remainder composed of Fe and an unavoidable impurity.

In the watch component of the present disclosure, a nitrogen content of the surface layer may be 1.0 to 1.6% by mass %.

A watch of the present disclosure includes the watch component.

DESCRIPTION OF EXEMPLARY EMBODIMENTS

Embodiments

A watch 1 of an embodiment of the present disclosure will be described below with reference to the drawings.

Figure 1:
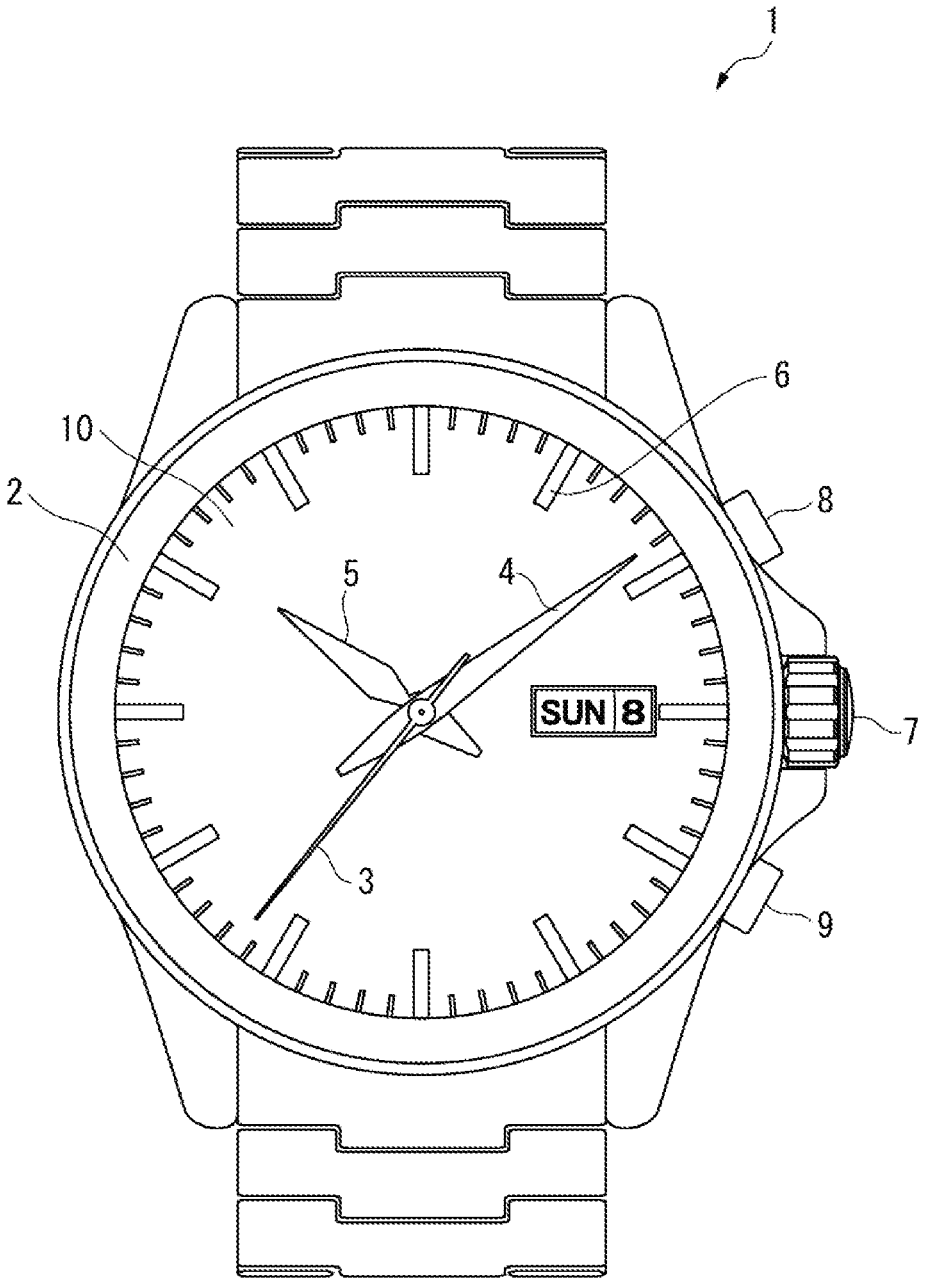
FIG. 1 is a front view illustrating a watch of an embodiment.

FIG. 1 is a front view illustrating the watch 1. In this embodiment, the watch 1 is configured as a wristwatch that is worn on the user's wrist.

As illustrated in FIG. 1, the watch 1 includes a metal case 2. In addition, inside the case 2, a disk-shaped dial 10, a second hand 3, a minute hand 4, a hand needle 5, a crown 7, an A-button 8 and a B-button 9 are provided. Note that the case 2 is an example of a watch component of the present disclosure.

The dial 10 is provided with an hour mark 6 for indicating the time of day.

Case

Figure 2:
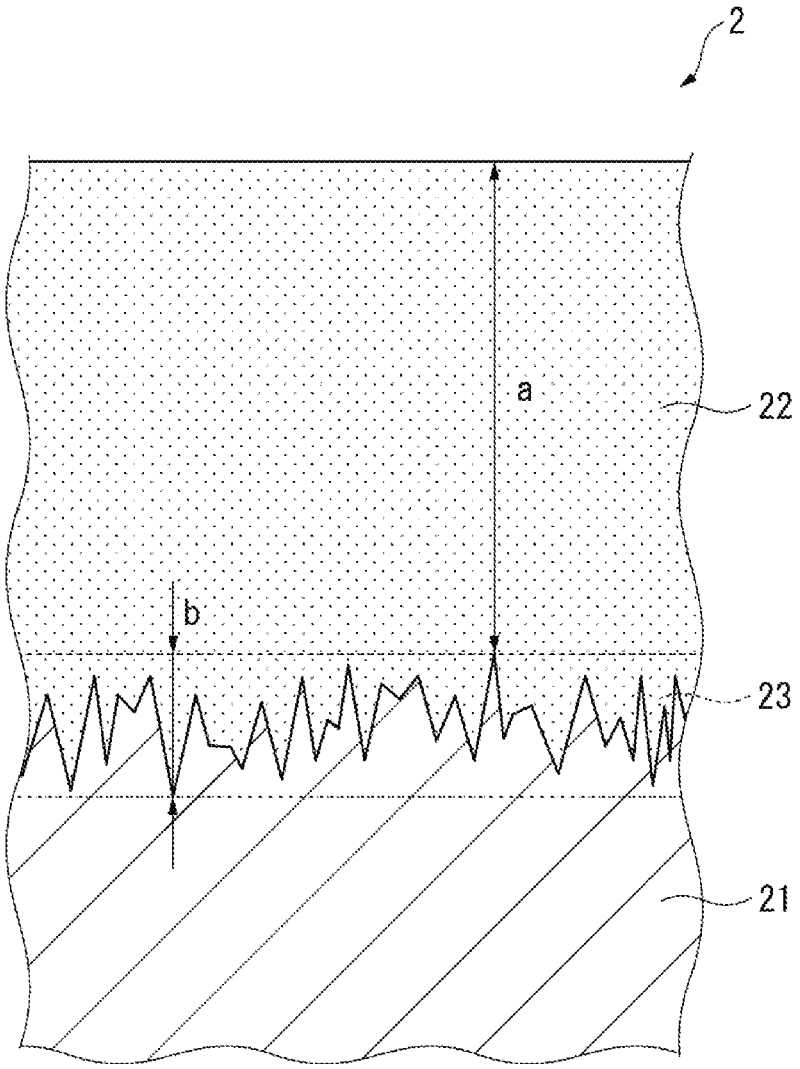
FIG. 2 is a cross-sectional view illustrating a main portion of a case.

FIG. 2 is a cross-sectional view illustrating a main portion of the case 2. FIG. 2 illustrates a cross-sectional view of the case 2 taken along the depth direction from the surface.

As illustrated in FIG. 2, the case 2 includes a base 21 composed of a ferrite phase, an austenized surface layer 22 formed on a surface of the base 21, and a mixed layer 23 in which the ferrite phase and the austenized phase are mixed, and the case 2 is composed of an austenized ferritic stainless steel.

Base

The base 21 is composed of ferritic stainless steel that contains, by mass %, 18 to 22% Cr, 1.3 to 2.8% Mo, 0.05 to 0.50% Nb, 0.1 to 0.8% Cu, less than 0.5% Ni, less than 0.8% Mn, less than 0.5% Si, less than 0.10% P, less than 0.05% S, less than 0.05% N, and less than 0.05% C, with the remainder composed of Fe and unavoidable impurities.

Cr is an element that increases the transfer rate of nitrogen to the ferrite phase and the diffusion rate of nitrogen in the ferrite phase in the nitrogen absorption treatment. When Cr is less than 18%, the transfer rate and diffusion rate of nitrogen is low. Further, when Cr is less than 18%, the corrosion resistance of the surface layer 22 is reduced. On the other hand, when the Cr exceeds 22%, it is hardened and the workability as the material is degraded. Further, when the Cr exceeds 22%, the aesthetic appearance is impaired. Therefore, the content of Cr is preferably 18 to 22%, more preferably 20 to 22%, even more preferably 19.5 to 20.5%.

Mo is an element that increases the transfer rate of nitrogen to the ferrite phase and the diffusion rate of nitrogen in the ferrite phase in the nitrogen absorption treatment. When Mo is less than 1.3%, the transfer rate and diffusion rate of nitrogen is low. Further, when Mo is less than 1.3%, the corrosion resistance as the material is reduced. On the other hand, when Mo exceeds 2.8%, it is hardened and the workability as the material is degraded. Further, when Mo exceeds 2.8%, the heterogeneity of the compositional structure of the surface layer 22 becomes significant and the aesthetic appearance is impaired. Therefore, the content of Mo is preferably 1.3 to 2.8%, more preferably 1.8 to 2.8%, even more preferably 2.25 to 2.35%.

Nb is an element that increases the transfer rate of nitrogen to the ferrite phase and the diffusion rate of nitrogen in the ferrite phase in the nitrogen absorption treatment. When Nb is less than 0.05%, the transfer rate and diffusion rate of nitrogen is low. On the other hand, when Nb exceeds 0.50%, it is hardened and the workability as the material is degraded. Further, precipitates are formed and the aesthetic appearance is impaired. Therefore, the content of Nb is preferably 0.05 to 0.50%, more preferably 0.05 to 0.35%, even more preferably 0.15 to 0.25%.

Cu is an element that controls the absorption of nitrogen in the ferrite phase in the nitrogen absorption treatment. When Cu is less than 0.1%, the variation in nitrogen content in the ferrite phase increases. On the other hand, when Cu exceeds 0.8%, the transfer rate of nitrogen to the ferrite phase is low. Therefore, the content of Cu is preferably 0.1 to 0.8%, more preferably 0.1 to 0.2%, even more preferably 0.1 to 0.15%.

Ni is an element that inhibits the transfer of nitrogen to the ferrite phase and the diffusion of nitrogen in the ferrite phase in the nitrogen absorption treatment. When Ni is 0.5% or greater, the transfer rate and diffusion rate of nitrogen are reduced. Further, the corrosion resistance may be degraded, and it may be difficult to prevent the occurrence of metal allergies and the like. Therefore, the content of Ni is preferably less than 0.5%, more preferably less than 0.2%, even more preferably less than 0.1%.

Mn is an element that inhibits the transfer of nitrogen to the ferrite phase and the diffusion of nitrogen in the ferrite phase in the nitrogen absorption treatment. When Mn is 0.8% or greater, the transfer rate and diffusion rate of nitrogen are reduced. Therefore, the content of Mn is preferably less than 0.8%, more preferably less than 0.5%, even more preferably less than 0.1%.

Si is an element that inhibits the transfer of nitrogen to the ferrite phase and the diffusion of nitrogen in the ferrite phase in the nitrogen absorption treatment. When Si is 0.5% or greater, the transfer rate and diffusion rate of nitrogen are reduced. Therefore, the content of Si is preferably less than 0.5%, more preferably less than 0.3%.

P is an element that inhibits the transfer of nitrogen to the ferrite phase and the diffusion of nitrogen in the ferrite phase in the nitrogen absorption treatment. When P is 0.10% or greater, the transfer rate and diffusion rate of nitrogen are reduced. Therefore, the content of P is preferably less than 0.10%, more preferably less than 0.03%.

S is an element that inhibits the transfer of nitrogen to the ferrite phase and the diffusion of nitrogen in the ferrite phase in the nitrogen absorption treatment. When S is 0.05% or greater, the transfer rate and diffusion rate of nitrogen are reduced. Therefore, the content of S is preferably less than 0.05%, more preferably less than 0.01%.

N is an element that inhibits the transfer of nitrogen to the ferrite phase and the diffusion of nitrogen in the ferrite phase in the nitrogen absorption treatment. When N is 0.05% or greater, the transfer rate and diffusion rate of nitrogen are reduced. Therefore, the content of N is preferably less than 0.05%, more preferably less than 0.01%.

C is an element that inhibits the transfer of nitrogen to the ferrite phase and the diffusion of nitrogen in the ferrite phase in the nitrogen absorption treatment. When C is 0.05% or greater, the transfer rate and diffusion rate of nitrogen are reduced. Therefore, the content of C is preferably less than 0.05%, more preferably less than 0.02%.

Surface Layer

The surface layer 22 is formed by applying the nitrogen absorption treatment to the surface of the base 21. In the present embodiment, the content of nitrogen in the surface layer 22 is 1.0 to 1.6% by mass %.

Mixed Layer

The mixed layer 23 is formed by variation in the transfer rate of nitrogen entering the base 21 composed of the ferrite phase in the process of forming the surface layer 22. Specifically, at the portion where the transfer rate of nitrogen is high, nitrogen reaches the deep portion of the base 21 and it becomes austenitic, and at a portion where the transfer rate of nitrogen is slow, it becomes austenitic only at a shallow portion of the base 21. Thus, the mixing layer 23 in which the ferrite phase and the austenized phase are mixed with respect to the depth direction is formed.

Here, in the present embodiment, the surface layer 22 and the mixed layer 23 are formed such that, in a cross section of the case 2 taken along the depth direction from the surface, i.e., in a cross section taken in the direction orthogonal to the surface, a thickness b of the mixed layer 23 is 45% or less of a thickness a of the surface layer 22.

Next, specific examples of the present disclosure are described.

Example 1

First, as shown in Table 1, a base material composed of ferritic stainless steel containing 20% Cr, 2.1% Mo, 0.2% Nb, 0.1% Cu, 0.05% Ni, 0.5% Mn, 0.3% Si, 0.03% P, 0.01% S, 0.01% N, and 0.02% C, with the remainder composed of Fe and unavoidable impurities was produced.

Next, by applying a nitrogen absorption treatment to the base material, a metal material in which an austenized surface layer is formed on the surface of the base was obtained.

The nitrogen absorption treatment was performed by the method described below.

First, a nitrogen absorption treatment device including a treatment chamber surrounded by a heat insulating material such as glass fibers, a heating means for heating the treatment chamber, a vacuum means for reducing the pressure inside the treatment chamber, and a nitrogen gas introduction means for introducing nitrogen gas into the treatment chamber was prepared.

Next, the above-described base material was placed in the treatment chamber of the nitrogen absorption treatment device, and then the pressure inside the treatment chamber was reduced to 2 Pa by the pressure reducing means.

Next, nitrogen gas was introduced by the nitrogen gas introduction means while exhausting the inside of the treatment chamber by the pressure reducing means, and the pressure inside the treatment chamber was maintained at 0.08 to 0.12 MPa. In this state, the temperature inside the treatment chamber was raised to 1200° C. at a rate of 5° C./minute by the heating means.

Then, the temperature was maintained at 1200° C. for 4.0 hours, which is the treatment time determined for setting the thickness of the surface layer to 450 μm. Note that the treatment time of 4.0 hours was determined through a preliminary test. In addition, the reason that the thickness a of the surface layer is set to 450 μm is that this value was determined in the preliminary experiment as a value that can achieve the corrosion resistance and the hardness required for a watch component.

The base material was then quenched by water cooling. In this manner, a metal material in which an austenized surface layer is formed on the surface of the base, and a mixed layer in which the austenized phase and the ferrite phase are mixed is formed between the base and the surface layer was obtained.

Examples 2 to 10

A metal material was obtained by setting the composition of the ferritic stainless steel constituting the base material as shown in Table 1, and by applying a nitrogen absorption treatment similar to that of Example 1 to the base material. Note that the treatment times in Example 2 to 10 were determined through preliminary tests.

Comparative Examples 1 to 3

A metal material was obtained by setting the composition of the ferritic stainless steel constituting the base material as shown in Table 1, and by applying a nitrogen absorption treatment similar to that of Example 1 to the base material. Note that the treatment times of Comparative Examples 1 to 3 were determined through preliminary tests.

Measurement of Thickness a of Surface Layer and Thickness b of Mixed Layer

A given portion of the metal material produced in each of Examples and Comparative Examples was cut from the surface along the depth direction, i.e., along the direction orthogonal to the surface, and then the cut surface was polished.

Thereafter, the thickness a of the surface layer and the thickness b of the mixed layer in the cut surface were measured through observation of the structure of the cut surface with SEM. Then, the ratio of the thickness b of the mixed layer with respect to the thickness a of the surface layer, i.e. "b/a" was determined. Here, the thickness a of the surface layer is the thickness of the layer composed of the austenized phase, and is the shortest distance from the surface of the surface layer to the ferrite phase of the mixed layer in the field of view in SEM observation at a magnification of 500 to 1000, for example. Alternatively, the thickness a of the surface layer may be set to an average value of the distances measured at a plurality of points where the distance from the surface of the surface layer to the ferrite phase of the mixed layer is short. In addition, the thickness b of the mixed layer is the thickness of the layer in which the ferrite phase and the austenized phase are mixed, and is the longest distance from the boundary of the surface layer and the mixed layer, i.e., the thickness a, to the ferrite phase of the mixed layer in the field of view in SEM observation at a magnification of 500 to 1000, for example. Alternatively, the thickness b of the mixed layer may be set to an average value of the distances measured at a plurality of points where the distance from the surface of the surface layer to the ferrite phase of the mixed layer is long.

Note that when observing the structure of the cut surface, the ferrite phase may be etched using an etching agent. This clarifies the boundary between the austenized phase and the ferrite phase, thus making it easier to observe the structure of the cut surface.

TABLE 1

| | Content [mass %] | | | | | | | | | | |
|---|---|---|---|---|---|---|---|---|---|---|---|
| | Cr | Mo | Nb | Cu | Ni | Mn | Si | P | S | N | C |
| Example 1 | 20 | 2.1 | 0.2 | 0.1 | 0.05 | 0.5 | 0.3 | 0.030 | 0.010 | 0.01 | 0.02 |
| Example 2 | 18 | 2.0 | 0.2 | 0.1 | 0.05 | 0.5 | 0.3 | 0.030 | 0.010 | 0.01 | 0.01 |
| Example 3 | 22 | 2.3 | 0.2 | 0.1 | 0.05 | 0.5 | 0.3 | 0.030 | 0.010 | 0.01 | 0.03 |
| Example 4 | 19 | 2.3 | 0.2 | 0.1 | 0.05 | 0.8 | 0.3 | 0.030 | 0.010 | 0.01 | 0.03 |
| Example 5 | 20 | 1.9 | 0.2 | 0.1 | 0.05 | 0.5 | 0.3 | 0.040 | 0.010 | 0.01 | 0.03 |
| Example 6 | 20 | 2.6 | 0.2 | 0.1 | 0.05 | 0.5 | 0.3 | 0.030 | 0.010 | 0.01 | 0.03 |
| Example 7 | 19 | 2.5 | 0.4 | 0.1 | 0.23 | 0.5 | 0.0 | 0.050 | 0.010 | 0.01 | 0.05 |
| Example 8 | 18 | 2.2 | 0.3 | 0.1 | 0.05 | 0.5 | 0.5 | 0.030 | 0.010 | 0.02 | 0.02 |
| Example 9 | 21 | 2.4 | 0.1 | 0.1 | 0.05 | 0.5 | 0.3 | 0.030 | 0.040 | 0.01 | 0.02 |
| Example 10 | 21 | 2.1 | 0.3 | 0.1 | 0.50 | 0.6 | 0.3 | 0.030 | 0.010 | 0.01 | 0.02 |
| Comparative Example 1 | 25.3 | — | 0.0 | 0.01 | 0.01 | 0.2 | 0.5 | 0.009 | 0.001 | 0.02 | 0.03 |
| Comparative Example 2 | 18.3 | 2.3 | 0.2 | — | — | 0.3 | 0.2 | 0.022 | 0.001 | 0.02 | 0.01 |
| Comparative Example 3 | 25.8 | 2.0 | — | — | <0.01 | — | — | <0.002 | 0.002 | 0.02 | 0.00 |

Measurement of Nitrogen Content

The nitrogen content of the austenized surface layer was measured using an inert gas melting thermal conductivity method for the metal materials produced in Examples and Comparative Examples.

Magnetic Resistance Test

The metal materials produced in Embodiments and Comparative Examples were processed to produce watch cases having a wall thickness of 4 mm. Further, a movement used in general quartz watches was housed in the watch case, and the magnetic resistance test specified in "JIS B 7024" was carried out.

Evaluation Results: Variation of Austenized Phase

Evaluation results for Examples and Comparative Examples are shown in Table 2.

As shown in Table 2, in Examples 1 to 10 of the present disclosure, the thickness b of the mixed layer is 126 to 199

μm, and b/a is 28 to 44%. On the other hand, in Comparative Examples 1 to 3, the thickness b of the mixed layer is 400 to 1260 μm, and b/a is 89 to 280%. A conceivable reason for this is that in Comparative Example 1, Mo was less than 1.3% and that the transfer rate and diffusion rate of nitrogen were reduced. In addition, a conceivable reason is that in Comparative Example 2, Cu was less than 0.1%, and consequently the variation in nitrogen in the ferrite phase was significant. Further, a conceivable reason is that in Comparative Example 3, Nb was less than 0.05%, and consequently the transfer rate and diffusion rate of nitrogen were reduced.

This suggests that in Examples 1 to 10 of the present disclosure, the austenized phase was uniformly formed compared to Comparative Examples 1 to 3.

Evaluation Results: Nitrogen Content

As shown in Table 2, in Examples 1 to 10 of the present disclosure, the nitrogen content of the surface layer was 1.22 to 1.53%. On the other hand, in Comparative Examples 1 to 3, the nitrogen content of the surface layer was 0.78 to 0.89%. This suggests that in Examples 1 to 10 of the present disclosure, the transfer of nitrogen to the ferrite phase and the diffusion of nitrogen in the ferrite phase were facilitated in the nitrogen absorption treatment compared to Comparative Examples 1 to 3.

In addition, this suggests that in Examples 1 to 10 of the present disclosure, the treatment time of the nitrogen absorption treatment taken until the thickness a of the surface layer reached 450 μm was 3.7 to 4.7 hours, and the treatment time can be significantly reduced compared to Comparative Examples 1 to 3 in which the treatment time was 10.0 to 12.0 hours.

Evaluation Results: Magnetic Resistance

As shown in Table 2, in Examples 1 to 10 of the present disclosure, the magnetic resistance was 82 to 120 G, which is a value that can guarantee the first-class magnetic resistant watch specified in "JIS B 7024". On the other hand, in Comparative Examples 1 to 3, the magnetic resistance was 35 to 50 G, and the magnetic resistance was inferior to Examples 1 to 10. This suggests that in Examples 1 to 10 of the present disclosure, since b/a was small and the austenized phase did not significantly erode the ferrite phase compared to Comparative Examples 1 to 3, the thickness of the ferrite phase that functions as the magnetic resistance functional layer could be sufficiently ensured and the magnetic resistance was improved.

TABLE 2

| | Surface Layer a [μm] | Mixed Layer b [μm] | b/a [%] | Treatment Time [hr] | Magnetic Resistance [G] |
|---|---|---|---|---|---|
| Example 1 | 450 | 130 | 29 | 4.0 | 120 |
| Example 2 | 450 | 134 | 30 | 4.3 | 105 |
| Example 3 | 450 | 184 | 41 | 3.7 | 88 |
| Example 4 | 450 | 199 | 44 | 4.1 | 82 |
| Example 5 | 450 | 126 | 28 | 4.2 | 95 |
| Example 6 | 450 | 178 | 40 | 3.8 | 90 |
| Example 7 | 450 | 178 | 39 | 4.7 | 90 |
| Example 8 | 450 | 184 | 41 | 4.1 | 95 |
| Example 9 | 450 | 165 | 37 | 4.4 | 99 |
| Example 10 | 450 | 173 | 38 | 4.6 | 85 |
| Comparative Example 1 | 450 | 1260 | 280 | 12.0 | 35 |
| Comparative Example 2 | 450 | 400 | 89 | 10.0 | 50 |
| Comparative Example 3 | 450 | 1050 | 233 | 12.0 | 43 |

Figure 3:
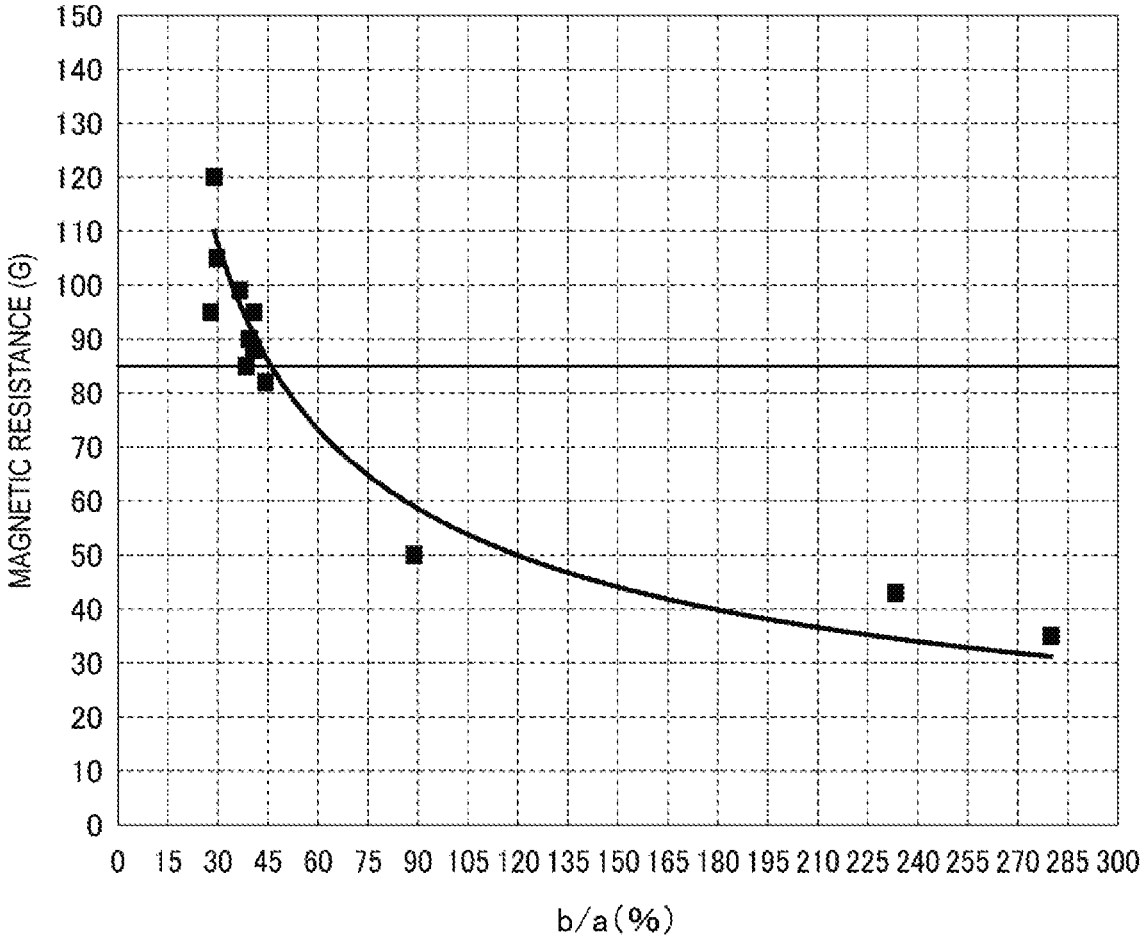
FIG. 3 is a graph showing a relationship between b/a and magnetic resistance.

FIG. 3 is a graph showing a relationship between b/a and the magnetic resistance in Examples 1 to 10 and Comparative Examples 1 to 3. Note that in FIG. 3, the line drawn at a magnetic resistance of 85 G indicates the magnetic resistance required to guarantee the first-class magnetic resistant watch specified in "JIS B 7024". Specifically, in the case where a movement used in an ordinary quartz watch is housed in a watch case having a thickness of 4 mm, the first-class magnetic resistant watch can be guaranteed when the magnetic resistance of the watch case is 85 G or greater.

As illustrated in FIG. 3, it was suggested that when b/a is 45% or less, i.e., when the thickness of the mixed layer is 45% or less of the thickness of the surface layer, it is possible to ensure 85 G or greater, which can basically guarantee the magnetic resistance of the first-class magnetic resistant watch. This suggests that in Examples 1 to 10 of the present disclosure, the magnetic resistance of the first-class magnetic resistant watch can be ensured. Note that in the process of the present embodiment, b/a does not become 0%, i.e., the thickness b of the mixed layer does not become zero, but is empirically known to be 10% or greater.

Modification Example

Note that the present disclosure is not limited to each of the embodiments described above, and variations, modifications, and the like within the scope in which the object of the present disclosure can be achieved are included in the present disclosure.

In the embodiments described above, the watch component of the present disclosure is configured as the case 2, but the present disclosure is not limited thereto. For example, the watch component of the present disclosure may be configured as a bezel, a case back, a band, a crown, a button, or the like.

In the embodiments described above, the metal material whose base member is composed of ferritic stainless steel of the present disclosure constitutes a watch component, but the present disclosure is not limited thereto. For example, the metal material of the present disclosure may constitute a case of an electronic device other than a watch, i.e., a component of an electronic device such as a housing. With a housing composed of such a metal material, the electronic device can have a high hardness and corrosion resistance.

What is claimed is:

1. An austenized ferritic stainless steel comprising:

a base including a ferrite phase;

a surface layer formed on a surface of the base, the surface layer including an austenized phase; and a mixed layer formed between the base and the surface layer, the mixed layer being a layer in which the ferrite phase and the austenized phase are mixed, wherein in a cross section taken along a depth direction from the surface, a thickness of the mixed layer is 45% or less of a thickness of the surface layer; and wherein the base contains, by mass %, 18 to 22% of Cr, 1.3 to 2.8% of Mo, 0.30 to 0.50% of Nb, 0.1 to 0.2% of Cu, less than 0.5% of Ni, 0.5 to 0.8% of Mn, less than 0.5% of Si, less than 0.10% of P, less than 0.05% of S, less than 0.05% of N, and less than 0.05% of C, with a remainder being composed of Fe and unavoidable impurities.

2. The austenized ferritic stainless steel according to claim 1, wherein a nitrogen content of the surface layer is 1.0 to 1.6% by mass %.

3. A watch comprising the austenized ferritic stainless steel according to claim 1.

4. A watch comprising the austenized ferritic stainless steel according to claim 2.

5. The austenized ferritic stainless steel according to claim 1, wherein the base contains 0.1 to 0.15 mass % of Cu.

* * * * *